US008833284B1

(12) United States Patent
Resta

(10) Patent No.: US 8,833,284 B1
(45) Date of Patent: Sep. 16, 2014

(54) TWO TUNNEL, FOUR HULL, TRIMARAN-CATAMARAN, FLYING BOAT

(71) Applicant: Daniel Resta, Brooklyn, NY (US)

(72) Inventor: Daniel Resta, Brooklyn, NY (US)

( * ) Notice: Subject to any disclaimer, the term of this patent is extended or adjusted under 35 U.S.C. 154(b) by 0 days.

(21) Appl. No.: 14/100,092

(22) Filed: Dec. 9, 2013

(51) Int. Cl.
*B63B 1/00* (2006.01)
*B63B 1/12* (2006.01)

(52) U.S. Cl.
CPC ..... *B63B 1/125* (2013.01)
USPC ..... 114/61.1; 114/61.2; 114/282

(58) Field of Classification Search
USPC ..... 114/61.1, 61.2, 282
IPC ..... B63B 1/125
See application file for complete search history.

(56) References Cited

U.S. PATENT DOCUMENTS 2,503,480 A * 4/1950 Gruszecki ..... 440/9
3,354,857 A * 11/1967 Hobday ..... 114/282
7,487,736 B2 * 2/2009 Daley ..... 114/271
7,963,240 B1 * 6/2011 Werner ..... 114/61.1

* cited by examiner

*Primary Examiner* — Stephen Avila
(74) *Attorney, Agent, or Firm* — Joseph R. Carvalko

(57) ABSTRACT

This invention is a two tunnel, four hull, trimaran-catamaran, flying boat that incorporates hydrodynamic planing surfaces with the benefit of aerodynamic lift. A boat that accommodates two people, such that, the pilot and passenger sit back to back in a low, semi-reclining position in a distinctive fuselage along the centerline, situated between and below a wing structure on either side, and thus forming the mid-structure of a trimaran. This fuselage flys in air above the water line. A streamlined canopy structure is located overhead and above the wing. The horizontal wing structure forms two tunnels below, each on either side of the centerline fuselage, providing a chamber for aerodynamic lift. Outboard of the wings are the catamaran hull arrangements with two hulls forward of amidship in parallel, followed in tandem by two hulls aft. The four hulls provide hydrodynamic lift.

8 Claims, 8 Drawing Sheets

TWO TUNNEL, FOUR HULL, TRIMARAN-CATAMARAN, FLYING BOAT

FIELD OF INVENTION

The invention relates generally to a small planing boat for both smooth and rough water operation, and embodiments adaptable for operation with various motor and drive systems.

BACKGROUND OF THE INVENTION

This invention refers to a class of boats that stems from an original technical approach to a planing boat design to provide for a union of architecture and boat engineering, referred to throughout variously as a two tunnel, four hull, trimaran-catamaran, flying boat that incorporates hydrodynamic planing surfaces with the benefit of aerodynamic lift at higher velocity, as provided by unique wing design.

In general, this invention provides for a boat that efficiently accommodates two people with a minimum amount of surrounding structure, not unlike the geometric considerations one might find in a sports car, even though some of the features may be integrated into a larger form. The size and dimensions of the various structures are a function of their relation to the human form. The pilot and passenger sit juxtaposed back to back in a low, semi-reclining position in a distinctive pod or fuselage along the centerline, situated between and below a wing structure on either side of the passengers, said wing structure forming the mid-structure of a trimaran. This fuselage becomes airborne a above the water line, as such it is traversing or flying in air free from hydrostatic drag. A streamlined canopy structure is located overhead and above the wing. The raised horizontal wing structure forms two tunnels below, each on either side of the centerline fuselage, providing a chamber for aerodynamic lift at higher speeds. The leading edge of the primary wings serves both a graphic and functional purpose in that it graphically forms a pointed edge like the point of an arrow suggesting forward movement, and functionally allows equal pressure on both upper and lower surfaces for vertical stability while funneling air below to the primary wings for aerodynamic lift. Outboard of the wings are the catamaran hull arrangements with two hulls forward of amidship in parallel, followed in tandem by two hulls aft. In between the fore and aft hulls is a distinct break or step, providing for four individual hulls. Each of the four hulls provide hydrodynamic lift at speed, while the curved break or gap between the hulls creates a vent relieving excessive air build-up beneath the wings at higher speeds, avoiding a possible flipping over backward.

The arrangement of three long and narrow hulls (two submerged and one airborne), provide hydrodynamic lift at both lower speeds and higher speeds, while at the same time, contribute to seaworthiness and comfort in so small a craft because the long and narrow shape of the hulls will penetrate waves instead of pounding, which is inherent in a wider hull. The flat surface of the wing arrangement, located a distance above the waterline, avoids slamming and pounding, while providing aerodynamic lift, vertical stability and a cushion of air for comfort when the higher speeds are attained. Less wetted area and thereby greater efficiency is achieved by: 1) the center hull being above the water; 2) the four hull, stepped hull configuration; and 3) the benefit of aerodynamic lift. In addition, greater efficiency is advanced through a minimal section area and aerodynamic streamlining. The model is effective at both lower and higher speeds and exhibits a two stage performance.

SUMMARY OF THE INVENTION

The present invention relates to a planing trimaran boat including a centerline hull and a continuous fuselage above a waterline surface, said hull supported on each side by a pair of opposing wings, each said wing located above the lower portion of said fuselage, and lying substantially in a horizontal plane, said wings forming a pair of tunnels that collect air, the outer portion of said tunnels formed by opposing catamaran hulls.

Another embodiment of the present invention relates to a planing trimaran boat including a hull having a chine substantially in the form of a sine curve, the forward portion of the sine curve rising to facilitate a fine bow entry at two front fore hulls, having an after portion that sweeps upward such that a spray rail is created above a lower chine at two aft rear hulls, said lower chine rising at the forward end of the aft hulls to form a bow shape; said chine merging into the upper portion of one of a gap or step between the fore and aft hulls and the bottom of a run of the aft hulls and after portion of the fore hulls having substantially a uniform deadrise angle, said angle progressively increasing toward the bow of the fore hulls.

In yet another embodiment of the present invention relates to a process including: forcing air below two wings forming two adjacent tunnels, said tunnels separated by a centerline hull; providing pressure both top and bottom for vertical stability at high velocity while funneling air below the wings for lift; compressing forced air between the wing surface and water surface creating a high pressure area below the wing while the aerodynamic shape of the top of the wing and hull structure create a low pressure area inducing partial aerodynamic lift, such that at expected velocities, said two wings are located a distance above the water line to avoid slamming into the sea.

BRIEF DESCRIPTION OF THE DRAWINGS

Understanding of the present invention will be facilitated by consideration of the following detailed description of the preferred embodiments of the present invention taken in conjunction with the accompanying drawings wherein.

DETAILED DESCRIPTION

Figure 1:
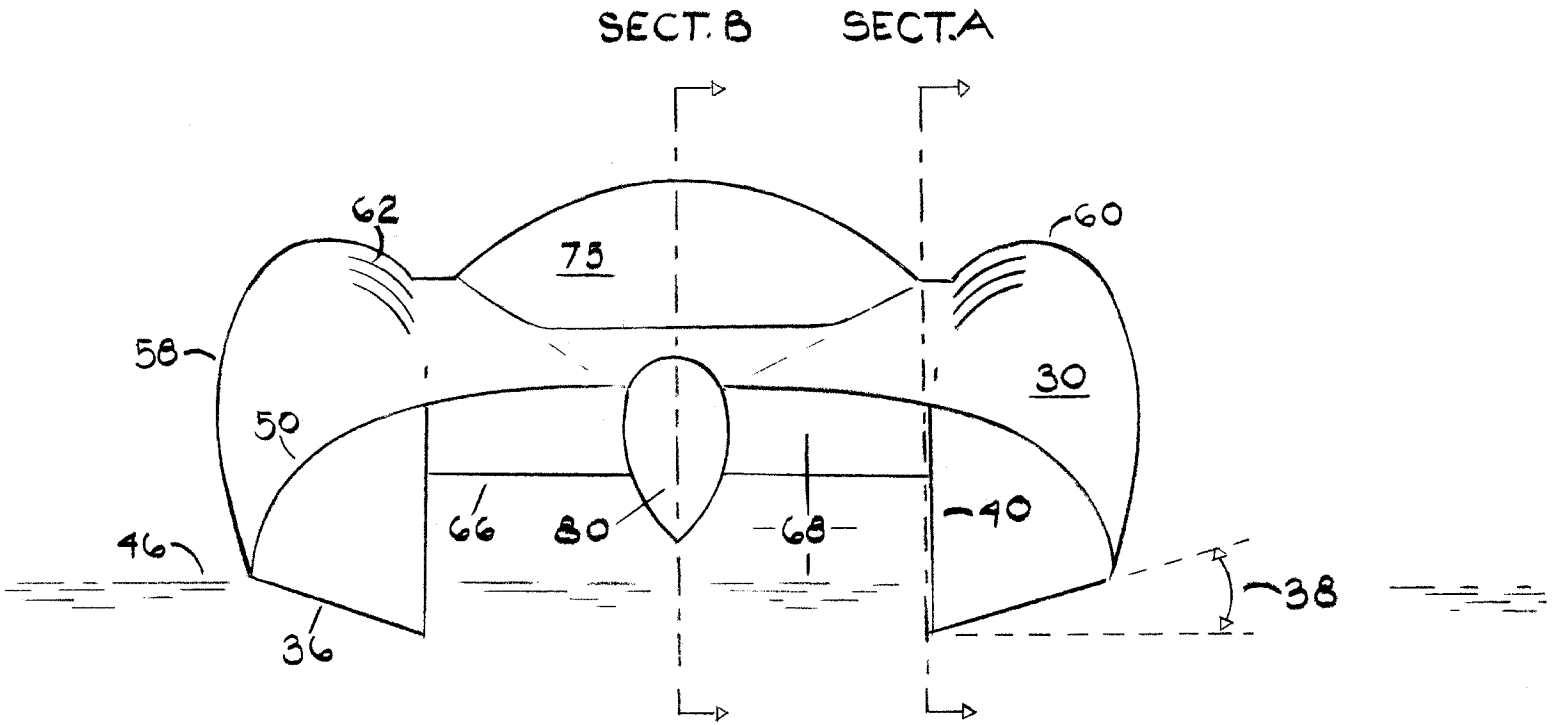
FIG. 1 is a section view looking aft in accordance with one embodiment of the present invention.

It is to be understood that the figures and descriptions of the present invention have been simplified to illustrate elements that are relevant for a clear understanding, while eliminating, for the purpose of clarity, many other elements found in boats of the current type disclosed herein. Those of ordinary skill in the art may recognize that other elements and/or steps may be desirable in implementing the present invention. However, because such elements and process steps are well known by those of ordinary skill in the art, and because they do not facilitate a better understanding of the present invention, a discussion of such elements and steps is not provided herein.

The following description includes the best mode of carrying out the invention. The detailed description is made for the purpose of illustrating the general principles of the invention and should not be taken in a limiting sense. The scope of the invention is determined by reference to the claims. Each part is assigned, even if structurally identical to another part, a unique reference number wherever that part is shown in the drawing figures.

One embodiment of the present disclosure as shown in FIGS. 1, 3, 5 and 6 relates to the planing boat including a trimaran configuration whereby a centerline hull (70) (FIGS. 3, 5 and 6) includes a continuous fuselage structure (70) above a waterline surface (46), said hull supported on each side by a pair of opposing wings (66), each said wing located above the lower portion (70) of said fuselage, and lying substantially in a horizontal plane, said wings forming a pair of tunnels (68) that collect air and thus generate at high velocity aerodynamic lift, the outer portion of said tunnels formed by opposing catamaran hulls (30 and 32).

Figure 4:
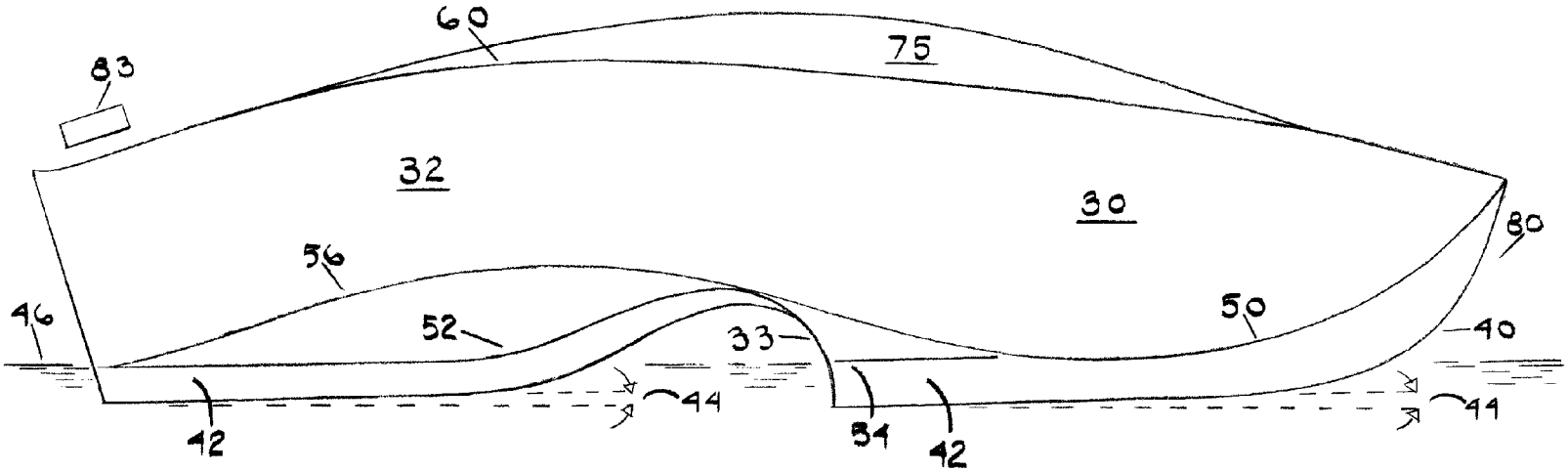
FIG. 4 is a side elevation of a boat design in accordance with one embodiment of the present invention.

In another embodiment of the disclosure relating to the planing boat, FIG. 4 illustrates a hull with a chine (50) substantially in the form of a sine curve, the forward portion of the sine curve rising to facilitate a fine bow entry at two front fore hulls (30), having an after portion that sweeps upward creating a spray rail (56) above a lower chine at two aft rear hulls (32), said lower chine rising at the forward end of the aft hulls to form a bow shape and said chine merging into the upper portion of a gap (33) or step between the fore and aft hulls and the bottom of the run of the aft hulls and after portion of the fore hulls having substantially a uniform deadrise angle (38) (also, FIG. 5), and increasing progressively toward the bow of the fore hulls to provide a desirable and sharp entry.

With further reference to FIG. 1 athwart ship deadrise angle 38 (the angle which the bottom section makes to the horizontal) of the bottom 36 of the two asymmetric catamaran aft hulls 32 may vary from about a 24 degree deadrise angle 38 to something less, depending on a preference for greater rough water capability with a higher angle or a choice of somewhat of a less of an angle for the purpose of greater efficiency. The angle should be the same throughout its run but progressively flattens going forward as it approaches the uppermost section of the gap or step 33 (FIG. 4) between fore 30 and aft 32 (FIG. 4) asymmetric catamaran hulls. The after portion of the bottom of the two forward hulls should be of equal deadrise angle as the run of the aft hulls but increase in angle toward the stem 40 to form a desirable entrance. The run or planing surface 42, of all four hulls, should possess, in a fore and aft direction, a plane angle 44 of about 2 to 3 degrees, sloping downward going aft.

With further reference to FIG. 4, an aspect of the chine system is dominated by the pronounced sine curve 50 that runs from bow to stern, it rises at the bow to facilitate a fine entry and sweeps down to the planing surface of the forward hulls, not unlike a typical chine at the forward end of a typical boat, but then sweeps up afterward to become a spray rail 56 at the aft hulls. A second chine 52 emerges off the aforementioned gap between the hulls, continues downward to form the bow and run of the aft hulls in order to throw the spray cleanly from the after hulls. There appears additionally, a third and short in length horizontal chine 54 at the point where the primary chine at the forward hulls sweeps upward, in order to insure a clean break from the hull of the bow wave at this juncture. For clarity, the chine is the juncture of the bottom 36 with the side 58 of the boat. In addition, the primary chine 50 resolution is a graphic illustration and visual representation of the bow wave in motion.

Figure 2:
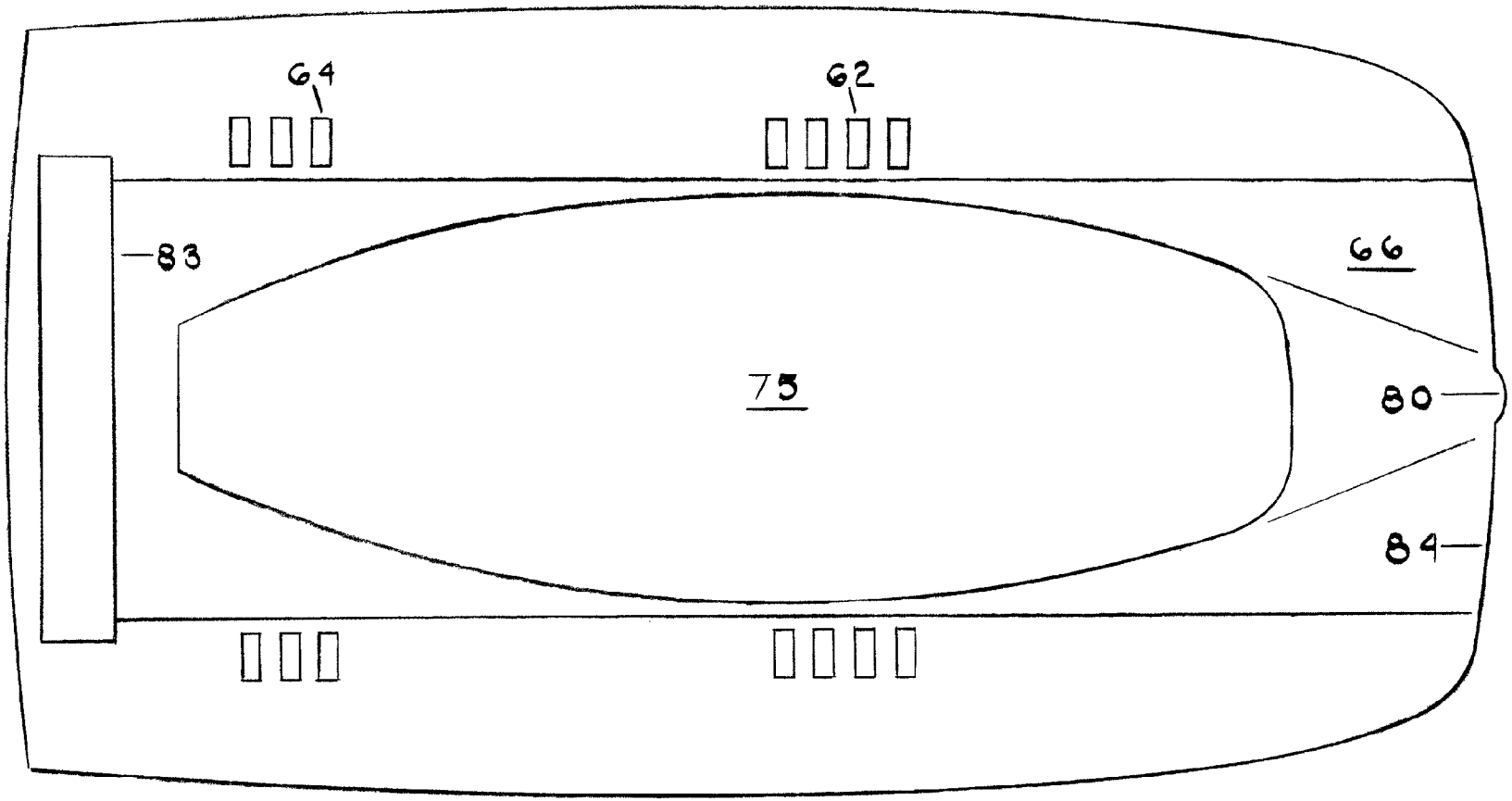
FIG. 2 is a plan view of the same, showing a plan of the hull super structure in accordance with one embodiment of the present invention.
Figure 5:
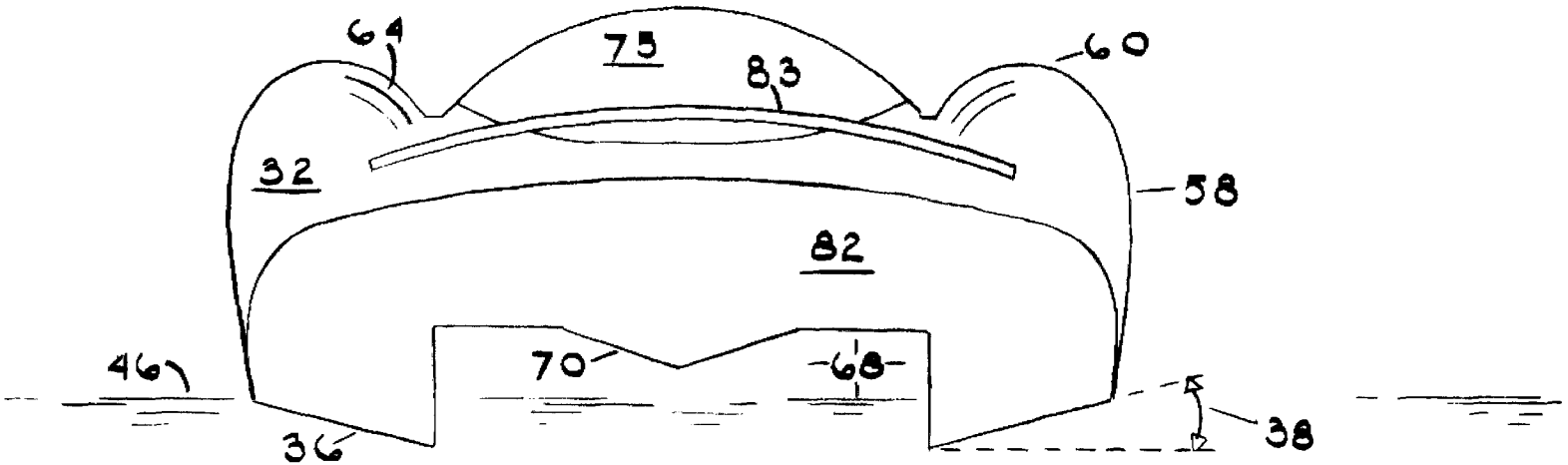
FIG. 5 is a section view looking forward in accordance with one embodiment of the present invention.

Turning attention to FIG. 5, rounded edge sheer line curve 60 sweeps back in harmony with the chine but also integrates two functions. Toward the visual high point of the sheer 60, there exists louvered openings both front 62 (FIG. 2) and back 64 (FIG. 2, FIG. 5), that forms a chamber right through, that serves two functions: (1) to provide an entry point for the induction of air ventilation for the cabin compartment and also air for the operation of the motor; and (2), the after part of the openings to allow engine heat to escape. The air openings are located on the inside of the crown of the sheer line to prevent any water spray from entering the boat. In addition, a high aspect ratio transverse wing 83 spanning the two aft hulls at the transom 82 performs supplemental lift.

Figure 3:
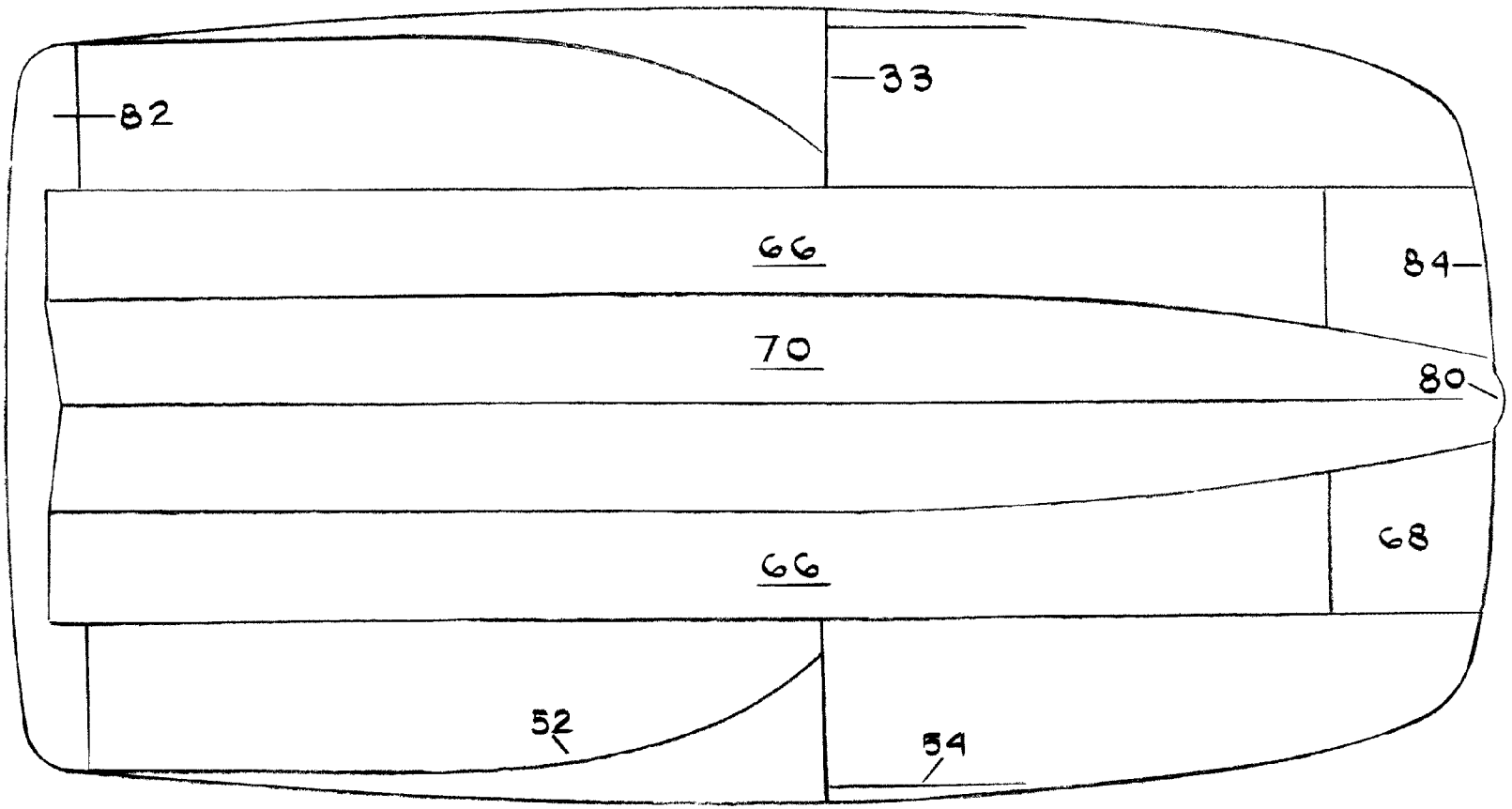
FIG. 3 is a bottom plan view showing the bottom structure in accordance with one embodiment of the present invention.

As shown in FIG. 1, FIG. 3, the two primary wings 66 are located higher above the waterline than typically may be found on a boat of this size, and positions them farther up, out of danger of impact with the sea. As speed increases, air is compressed within the two tunnels 68, generating lift which is commonly described as the result of surface effect. The leading edge 84 of the two primary wings form a pointed edge which functionally separates the air flow to both upper and lower surfaces and thusly, providing pressure on each surface at higher velocity, to promote vertical stability.

Figure 6:
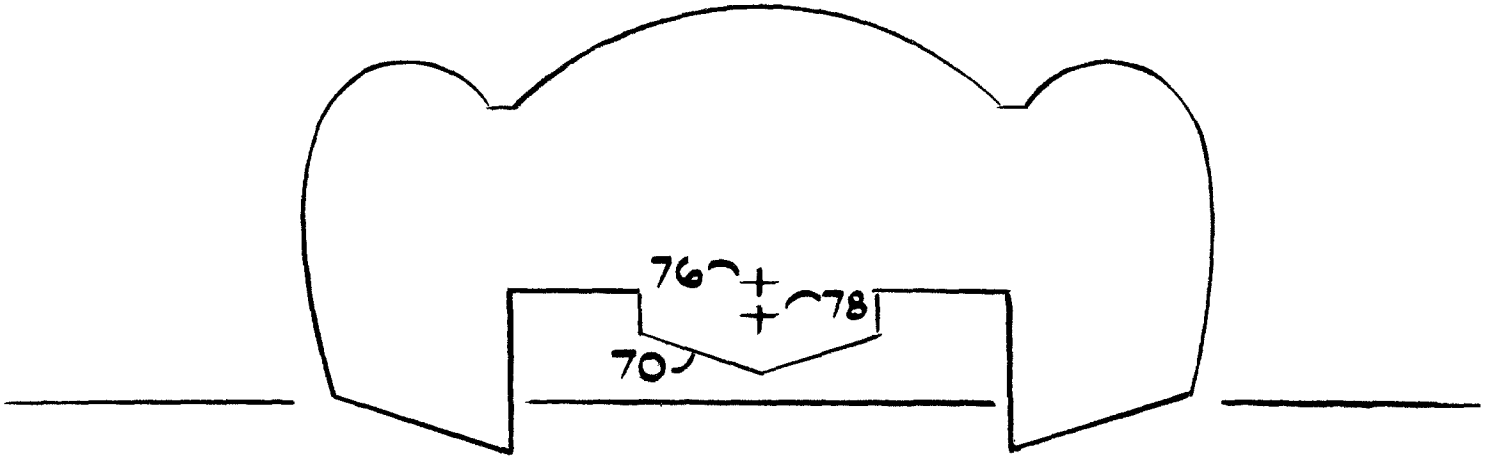
FIG. 6 is a mid-section view at the step in accordance with one embodiment of the present invention.
Figure 7:
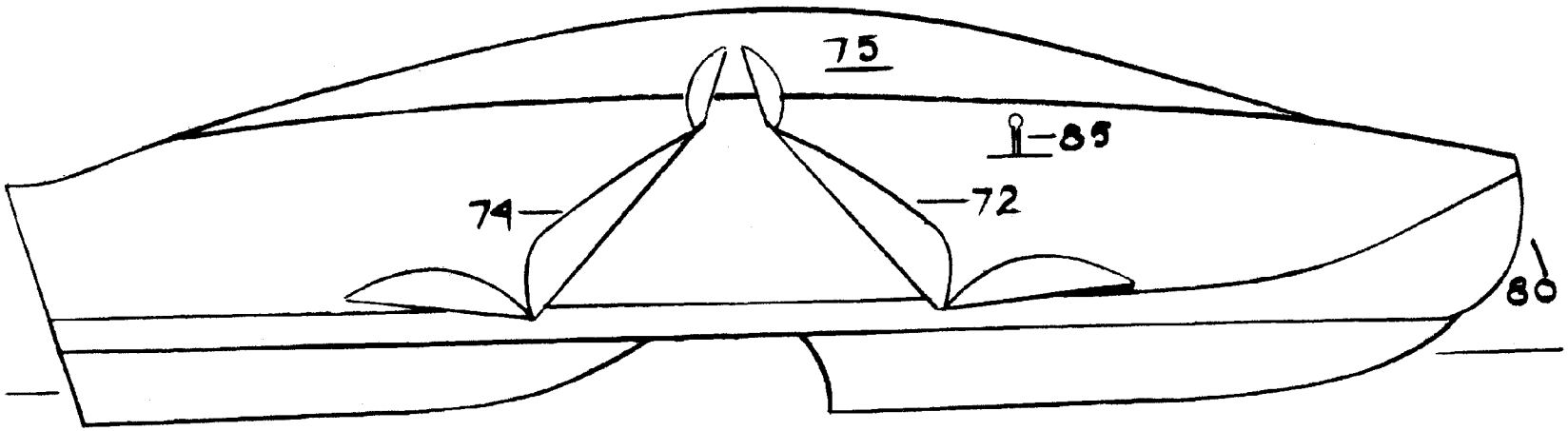
FIG. 7 is section A which shows an interior seating arrangement in accordance with one embodiment of the present invention.
Figure 8:
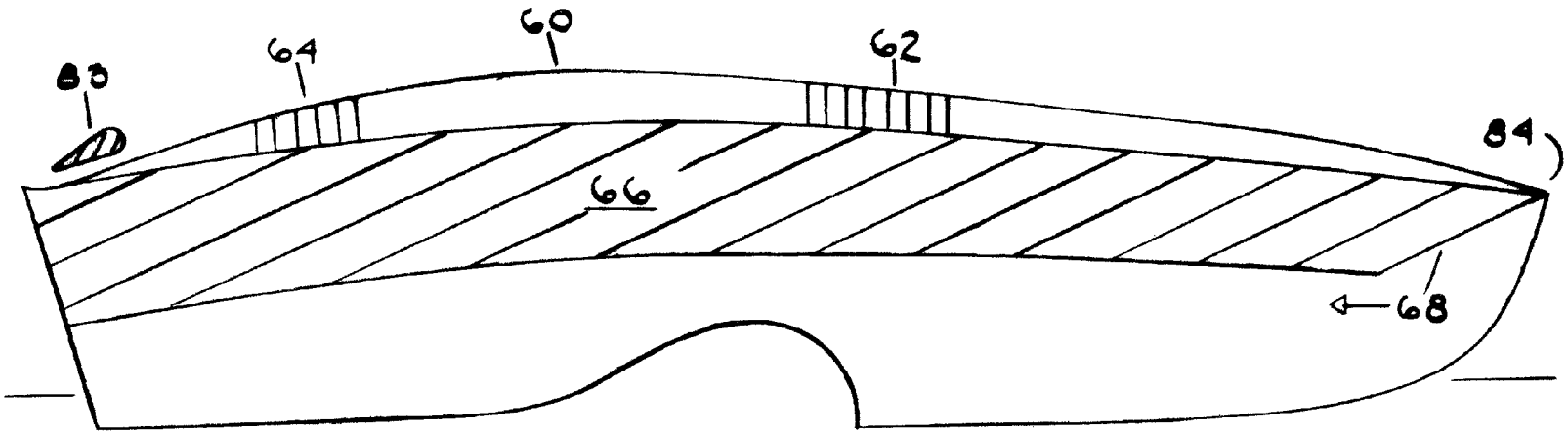
FIG. 8 is section B which illustrates the unique aerodynamic wing structures in accordance with one embodiment of the present invention.

Now referring to FIG. 3, FIG. 7, the aerodynamic centerline fuselage 70 carries a pilot in pilot seat 72 and passenger seat 74. In FIG. 3, FIG. 6, third hull 70 allows the boat to travel substantially in air, being supported by the aerodynamic wings and hydrodynamic hulls. The intervals during which this hull touch waters occurs during high wave action coupled with speed, and in that case the hull provides reserve buoyancy. Another aspect of locating the pilot and passenger in a position below the wing but just above the waterline, is that it lowers the center of gravity 76, FIG. 6, which is positive for stability. Furthermore, this low position is closer to the center of the roll axis which by definition is most comfortable because the center of the roll axis 78 is optimally close to the waterline 46 and has the least amount of roll. A streamlined canopy 75 located above the primary wings encloses both pilot and passenger, thereby protecting them from the elements. Steering is controlled by two vertical tillers 85, one to the left hand and one to the right hand of the operator, thereby allowing a clear line of sight for the operator, without the visual obstruction of a steering wheel.

In FIG. 7, the forward termination of the bow 80 of the central structure encompasses both aerodynamic and hydrodynamic architectural embodiment. The upper portion possesses a quasi-spherical quality one might find in aircraft design, while the lower portion seamlessly blends into a "V" section typical to boat design. The result being an original and unique solution serving both architectural and engineering demands and functions.

The motor accommodation can incorporate several applications. For example, an obvious installation would be to install two inboard motors, one each in the two trailing hulls 32 of the immersed catamaran arrangement. In another embodiment jet propulsion serves to power the boat. In yet another embodiment a motor, amidships of the passenger station, drives a propeller which has the benefit operating in clean water for maximum efficiency, since this third hull is flying above the water line reducing any interference.

In one non-limiting embodiment the overall length/beam ratio of the craft would fall approximately in a range substantially around 2.0.

In another embodiment disclosed herein is a planing boat aerodynamic process that includes forcing air below the two wings 66 forming two adjacent tunnels, said tunnels separated by the centerline hull 70; providing a top and bottom pressure for vertical stability at high velocity while funneling air below the wings for lift; compressing forced air between the wing surface 66 and a water surface creating a high pressure area below the wing 68 while the aerodynamic shape of the top of the wing and hull structure create a low pressure area inducing partial aerodynamic lift.

In yet another embodiment the process further includes ventilating the set of openings (62 and 64) forming a thru chamber at the high point of the sheer that serves as an entry point for one or more of air the ventilating the cabin compartment (72 and 74) and allowing engine heat to escape into the outside. In yet another embodiment the process further includes aerodynamically lifting the wing 83 located athwartship at the transom such that a supplemental aerodynamic lift is provided. In yet an another embodiment the process further includes locating the pilot and passenger in a position below the wing in a centerline hull 70 above the water line such that a lower center of gravity provides transverse and lateral stability and said low position coinciding with center of the roll axis.

In yet another embodiment the process further includes process where the centerline hull 70 is substantially airborne. Propulsion of the boat may be provided by the installation of two inboard motors and/or whereby propulsion is provided by a motor amidships at the centerline hull.

In yet an another embodiment the process further includes steering of the boat is controlled by two vertical tillers, one to the left hand and one to the right hand of an operator, thereby allowing a clear line of sight without the visual obstruction of a steering wheel.

While the present invention has been described with reference to the illustrative embodiments, this description is not intended to be construed in a limiting sense. Various modifications of the illustrative embodiments, as well as other embodiments of the invention, will be apparent to those skilled in the art on reference to this description. It is therefore contemplated that the appended claims will cover any such modifications or embodiments as fall within the true scope of the invention.

I claim:

1. A planing trimaran boat comprising a centerline hull and a continuous fuselage above a waterline surface, said hull supported on each side by a pair of opposing wings, each said wing located above the lower portion of said fuselage, and lying substantially in a horizontal plane, said wings forming a pair of tunnels that collect air, the outer portion of said tunnels formed by opposing catamaran hulls, and a forward termination of the bow of the centerline structure, such that the upper portion is defined by a quasi-spherical nose cone shape, while the lower portion merges into a conical "V" section.

2. A boat as in claim 1, wherein two hulls are situated in parallel fore of the midship and two hulls are situated in tandem and parallel aft, said fore and aft hulls separated by one of a gap or step.

3. A planing boat comprising a hull having a chine substantially in the form of a sine curve, the forward portion of the sine curve rising to facilitate a fine bow entry at two front fore hulls, having an after portion that sweeps upward such that a spray rail is created above a lower chine at two aft rear hulls, said lower chine rising at the forward end of the aft hulls to form a bow shape; said chine merging into the upper portion of one of a gap or step between the fore and aft hulls and the bottom of a run of the aft hulls and after portion of the fore hulls having substantially a uniform deadrise angle, said angle progressively increasing toward the bow of the fore hulls.

4. A boat as in claim 1, further including a sheer line curve that sweeps substantially back in parallel to a sine curve chine forming a side of the fore and aft hulls.

5. A planing boat aerodynamic process comprising:

(a) Forcing air below two wings forming two adjacent tunnels, said tunnels separated by a centerline hull;

(b) Providing a top and bottom pressure for vertical stability at high velocity while funneling air below the wings for lift;

(c) Compressing forced air between a wing surface and a water surface creating a high pressure area below the wing while the aerodynamic shape of the top of the wing and hull structure create a low pressure area inducing partial aerodynamic lift;

(d) ventilating a set of openings forming a thru chamber at the high point of the sheer that serves as an entry point for one or more of air ventilating the cabin compartment, and allowing engine heat to escape into the outside.

6. The process as in claim 5, further including aerodynamically lifting a wing located athwartship at the transom such that a supplemental aerodynamic lift is provided.

7. The process as in claim 5, whereby locating a pilot and a passenger in a position below the wing in a centerline hull above the water line such that a lower center of gravity provides transverse and lateral stability and said low position coinciding with center of the roll axis.

8. The process as in claim 7, where the centerline hull is substantially airborne.

* * * * *